US011849847B1

(12) United States Patent
Heath et al.

(10) Patent No.: US 11,849,847 B1
(45) Date of Patent: Dec. 26, 2023

(54) MODULAR MATTRESSES

(71) Applicants: Jared Heath, Frisco, TX (US); Sereen Heath, Frisco, TX (US)

(72) Inventors: Jared Heath, Frisco, TX (US); Sereen Heath, Frisco, TX (US)

( * ) Notice: Subject to any disclaimer, the term of this patent is extended or adjusted under 35 U.S.C. 154(b) by 0 days.

(21) Appl. No.: 16/741,128

(22) Filed: Jan. 13, 2020

Related U.S. Application Data

(60) Provisional application No. 62/791,907, filed on Jan. 14, 2019.

(51) Int. Cl.

| | |
|---|---|
| ***A47C 27/14*** | (2006.01) |
| ***A47C 27/00*** | (2006.01) |
| ***A47C 27/15*** | (2006.01) |
| ***A47C 27/08*** | (2006.01) |

(52) U.S. Cl.
CPC ..... *A47C 27/001* (2013.01); *A47C 27/085* (2013.01); *A47C 27/15* (2013.01)

(58) Field of Classification Search
CPC ..... A47C 27/14; A47C 27/142; A47C 27/144; A47C 27/146; A47C 27/148
See application file for complete search history.

(56) References Cited

U.S. PATENT DOCUMENTS 5,513,402 A * 5/1996 Schwartz ..... A47C 27/16 5/691
5,740,567 A * 4/1998 Mitchell ..... A47G 9/062 5/420
6,115,861 A * 9/2000 Reeder ..... A61G 7/05776 5/690
2001/0029632 A1* 10/2001 Parvin ..... B32B 5/14 5/727
2002/0040502 A1* 4/2002 Woolfson ..... A47C 27/148 5/690
2002/0112291 A1* 8/2002 Barman ..... A47C 31/105 5/716
2003/0177584 A1* 9/2003 Boyd ..... A47C 27/148 5/727
2006/0288490 A1* 12/2006 Mikkelsen ..... A47C 7/029 5/740
2007/0179864 A1* 8/2007 Leeds ..... B64D 11/0647 705/14.27
2008/0010751 A1* 1/2008 Kemper ..... A47C 27/146 5/655.9

(Continued)

*Primary Examiner* — Justin C Mikowski
*Assistant Examiner* — Ifeolu A Adeboyejo

(57) ABSTRACT

The present invention discloses a modular mattress that allows for customization of the overall firmness, thickness, and breathability of the mattress along with providing an optimal comfort to users. The modular mattresses comprise at least three modules of mattresses with different thicknesses include a lower, a middle, and a top mattress. The lower and middle mattresses are made of a material includes a polyurethane foam and the top mattress is made of a material made of a gel-infused viscoelastic memory foam. The mattresses are covered by a microfiber fabric cover. The cover of each mattress further comprises a hook and loop fabrics and rubberization. The hook fabric of the cover of the lower mattress mates with a center section of loop fabric sewn into a lower surface of the middle mattress to prevent movements during use. The modular mattresses provide optimum comfort to the user while sleeping and resting.

9 Claims, 7 Drawing Sheets

(56) References Cited

U.S. PATENT DOCUMENTS

| | | | | |
|---|---|---|---|---|
| 2008/0301983 | A1* | 12/2008 | Murphy | A47C 27/08 40/360 |
| 2008/0307583 | A1* | 12/2008 | Oh | A47C 27/15 5/740 |
| 2009/0070939 | A1* | 3/2009 | Hann | A61G 7/057 5/652.1 |
| 2010/0170042 | A1* | 7/2010 | Rose | A47C 27/15 5/698 |
| 2010/0175193 | A1* | 7/2010 | Oh | A47C 31/004 5/638 |
| 2011/0252572 | A1* | 10/2011 | Morrison | A47C 27/144 5/740 |
| 2012/0255120 | A1* | 10/2012 | Poston | A47C 31/105 5/499 |
| 2013/0263377 | A1* | 10/2013 | Wootten, Jr. | A47C 27/15 5/640 |
| 2014/0208517 | A1* | 7/2014 | Gross | A47C 27/085 5/691 |
| 2014/0304921 | A1* | 10/2014 | Collins | A47C 27/148 5/727 |
| 2015/0067967 | A1* | 3/2015 | Tyree | A47C 27/144 5/691 |
| 2015/0089747 | A1* | 4/2015 | Ni | A47C 27/15 5/691 |
| 2015/0351557 | A1* | 12/2015 | Allen | A47C 27/144 5/655.5 |
| 2016/0100697 | A1* | 4/2016 | Prochazka | A47C 31/123 5/669 |

* cited by examiner

MODULAR MATTRESSES

BACKGROUND OF THE INVENTION

A. Technical Field

The present invention generally relates to mattresses. More specifically, the present invention relates to a modular mattress allows for customization of the overall firmness, thickness, and breathability of the mattress along with providing an optimal comfort to users.

B. Description of Related Art

A mattress is a large pad for supporting the reclining human body, designed to be used as a bed or on a bed frame. Typically, mattresses are used by most of the people for sleeping and resting purposes. Sleeping requires an optimum comfort to a user's body. The lack of support and comfort is counterproductive to sleep and is responsible for many hours lost attempting to sleep. The mattress provides limited comfort for long hours of the night or whenever a person tries to get a restful amount of sleep.

Mattresses may consist of a quilted or similarly fastened case, usually of heavy cloth, that contains hair, straw, cotton, foam rubber, etc., or a framework of metal springs. Mattresses may also be filled with air or water. The first or early mattresses were usually a type of cloth bag or container stuffed with a variety of natural materials. The natural materials included straw, feathers, horse hair, coconut fiber, and any number of things that could be gathered in sufficient quantity to fill the large container enough to support the human body. The people began habitation in structures where bedding could remain dry a variety of disposable substances were used ranging from animal skins to piles of leaves, grass, or boughs of trees. Whatever the material would keep above the ground level to avoid drafts, dirt, and pests.

The modern mattress now consists of man-made, and natural fiber. Mattresses may consist of a fastened cover, usually of heavy cloth, that contains straw, cotton, foam rubber, and a framework of metal springs etc. to make up a vast variety of sleeping bed construction. The conventional mattress usually consists of two parts. The parts include an innerspring mattress that is traditionally supported by a base box spring. This configuration is popular although there is a great deal of interest in the modern foam beds that have increased comfort and could last longer than the conventional bed innerspring mattress. The foam mattress also has the advantage of being less complicated, offers more support, and could be used as a hybrid with the two-part configurations of top mattress and support of the box spring. The foam mattress is gaining in popularity and replacing the traditional innerspring and box spring combination as well as the hybrid combinations.

Replacing a typical mattress that is worn out could be expensive, and most of the people don't change their mattress. The mattress is being disposed of has still at least 50 percent of use left in it, but the construction of the mattress prevents the user from taking advantage of the remaining life in the product. During the course of using the mattress, the components, for example, springs and foam or straw, may get damaged or soiled thereby requiring repair, cleaning, and replacement.

Currently, the existing modular mattresses include at least two mattresses which are made of a foam material. The plurality of mattresses is secured each other via fasteners such as zippers. However, the zippers could be damaged due to wear and tear of the teeth during the course of using the mattresses. Due to lack of friction between the mattresses, they could move while using. The user couldn't feel comfort while sleeping or resting on the mattresses. Further, it is difficult to replace the old or worn out mattresses.

Therefore, there is a need to provide modular mattresses that could be easily assembled and disassembled from a bed frame when they are worn out. The new modular mattresses are configured to provide comfort to any user, for example, side sleepers, stomach sleepers, and back sleepers while sleeping or resting. The new modular mattresses allow the user to continually use the other modules of the mattresses and eliminate the replacement cost of the mattresses. There is also a need to provide modular mattresses with microfiber covers to hold or grip the other mattresses and prevents movements of the mattresses while using. Further, there is also a need to provide modular mattresses with different thicknesses to suit or comfortable for the user or individual.

SUMMARY OF THE INVENTION

The present invention generally discloses mattresses. Further, the present invention discloses a modular mattress that allows for customization of the overall firmness, thickness, and breathability of the mattress along with providing an optimal comfort to users.

According to the present invention, the modular mattresses is an innovative sleep product that has been designed to provide optimum comfort while sleeping or resting on the modular mattresses. In one embodiment, the modular mattresses comprise at least 3 modules of mattresses. In one embodiment, the 3 modules of mattresses are made of a material, but not limited to, a foam material. In one embodiment, the foam material could be, but not limited to, a gel memory foam. In one embodiment, the gel memory foam could be placed on a top of each mattress to provide the optimum sleeping temperature while conforming to the user's body. The 3 modules of mattresses could be purchased in soft, medium, or firm hardness levels.

In one embodiment, the at least 3 modules of mattresses have different thicknesses. In one embodiment, the modular mattresses could easy to assemble and disassemble repeatedly via, but not limited to, a fastener includes hook and loop fabrics. In one embodiment, the 3 modules of mattresses include a bottom or lower mattress, a middle mattress, and a top mattress. The mattresses are made from different materials and could be supplied in one of three different densities, i.e., soft, medium, and firm. The mattresses are supplied in 3 sections with each having a different task in providing the optimum comfort for the best sleep possible. The mattresses also are available in 4 sizes include twin, full, queen, and king.

In one embodiment, the lower mattress is made of a material, but not limited to, a polyurethane foam. This foam is supplied on one firmness to provide the most stable base possible for the mattress. In one embodiment, the lower mattress has a thickness in the range of about, but not limited to, 6 to 9 inches. In one embodiment, the lower mattress comprises a cover. In one embodiment, the cover includes a fastener, but not limited to, a hook fabric at the middle section. The hook fabric of the cover of the lower mattress mates with a center section of loop fabric sewn into a lower surface of the middle mattress to prevent movements during use. In one embodiment, the middle mattress is made of a material, but not limited to, a foam, a gel-infused viscoelastic memory foam, and a polyurethane foam. This foam is supplied in one of 3 firmness levels to begin to create the optimum comfort required by the user. The middle mattress has a thickness in the range of about, but not limited to, 4 to 6 inches. In one embodiment, an upper surface of the middle mattress could be coated with, but not limited to, at least three 2" wide stripes of silicone rubber, which prevents movement of the top mattress during use.

In one embodiment, the top mattress is made of a material, but not limited to, a gel infusion memory foam. The top mattress has a thickness in the range of about, but not limited to, 2 inches. In one embodiment, the gel infusion positioned at the top layer of the top mattress to maintains 69° F. at the point of body contact, which is the optimum in temperature for a good night's sleep. In one embodiment, a spun olefin fabric could be sewn on a top surface of the cover. The spun olefin fabric prevents liquid moisture from flowing into the top mattress yet lets it breathe exceptionally well, expelling any water vapor.

In one embodiment, each mattress could be covered by, but not limited to, a cover. In one embodiment, the cover is made of a material, but not limited to, a microfiber or microfibre. In one embodiment, the cover is 1800 thread count microfiber fabric. In one embodiment, hook and loop fabrics are sewn to the mating locations of the mattresses and the durable plastic end zippers are sewn so the cover could be removed for washing. In one embodiment, the covers could be supplied in almost any vibrant color, pattern, or texture, so a distinctive fabric may be chosen to enhance the product recognition factor, which could dramatically improve the market adoption of the modular mattresses.

In one embodiment, the bed frame could be a high-quality finished hardwood bed frame. The bed frame supports the mattress assembly up off the floor. In one embodiment, the lower mattress could be fabricated using, but not limited to, a polyurethane foam. In one embodiment, the modular mattresses could be infinitely upgradeable with multiple mattresses that could be easily assembled and disassembled from the bed frame.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1A:
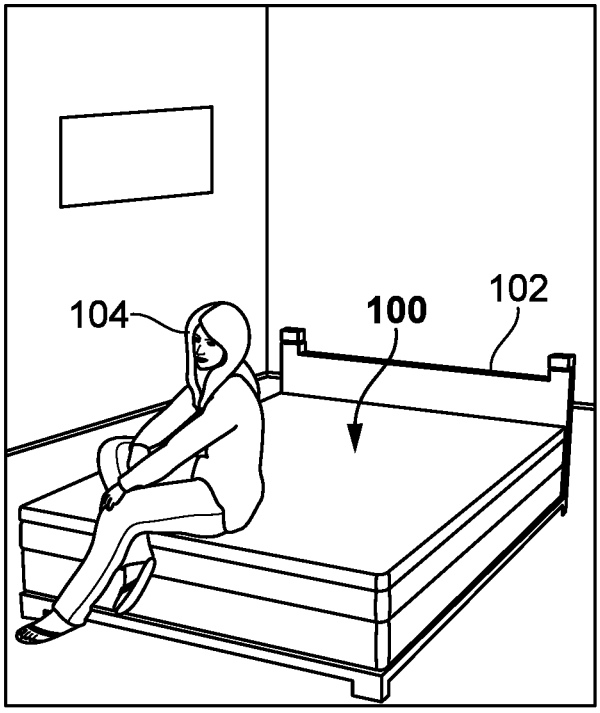
FIG. 1A shows a perspective view of modular mattresses assembled on a bed frame by a user in an embodiment of the present invention.

Referring to FIG. 1A, the perspective view of modular mattresses 100 assembled on a bed frame 102 by a user 104 is illustrated. In one embodiment, the modular mattresses 100 is an innovative sleep product that has been designed to provide the optimum in sleep and comfort while being easy to move and assemble. In one embodiment, the modular mattresses 100 are infinitely updatable with parts that are easily changed when they wear out over time. In one embodiment, the modular mattresses 100 allows continued use of the other modules of the mattress and eliminates replacement costs. In one embodiment, the modular mattresses 100 could also be changed and upgraded based on the user's requirement. In one embodiment, the user 104 could change the thickness or firmness of the modular mattresses 100 to suit for an individual. The modules allow customization that far surpasses any other type of mattress.

Figure 1B:
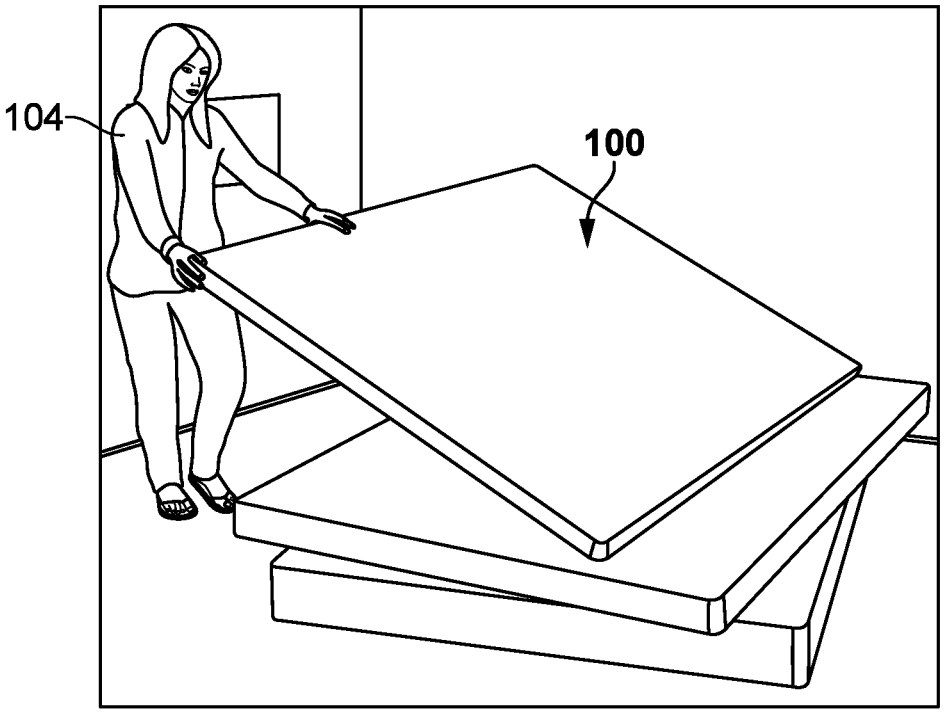
FIG. 1B shows a perspective view of the modular mattresses in an embodiment of the present invention.

Referring to FIG. 1B, the perspective view of the modular mattresses 100 is illustrated. In one embodiment, the modular mattresses 100 comprise at least 3 modules of mattresses. In one embodiment, the 3 modules of mattresses (106, 108, and 110) are made of a material, but not limited to, a foam material. The 3 modules of mattresses (106, 108, and 110) could be purchased in soft, medium, or firm hardness levels with a gel memory foam. In one embodiment, the gel memory foam could be placed on a top to provide the optimum sleeping temperature while conforming to the user's body.

Figure 2:
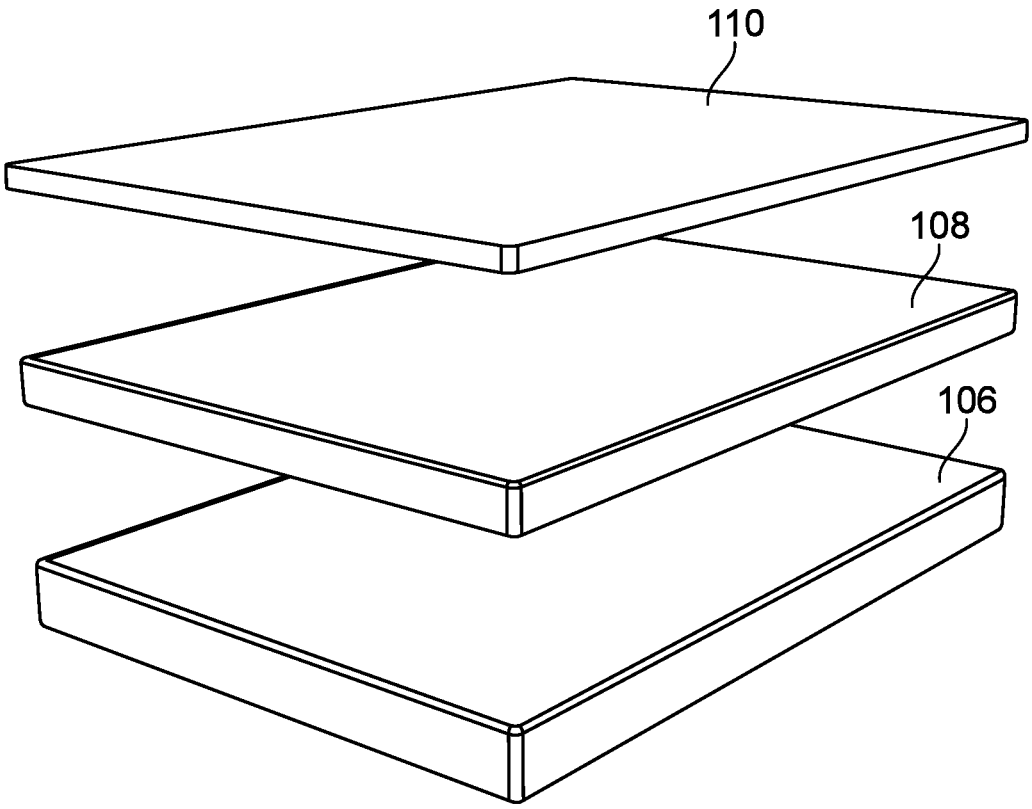
FIG. 2 shows a perspective view of 3 modules of mattresses with different thicknesses in an embodiment of the present invention.

Referring to FIG. 2, the perspective view of 3 modules of mattresses (106, 108, and 110) have different thicknesses is illustrated. In one embodiment, the modular mattresses 100 could easy to assemble and disassemble repeatedly. In one embodiment, the 3 modules of mattresses include a bottom or lower mattress 106, a middle mattress 108, and a top mattress 110. In one embodiment, the 3 mattresses (106, 108, and 110) have different thicknesses. In one embodiment, the lower mattress 106 is made of a material, but not limited to, a polyurethane foam. In one embodiment, the lower mattress 106 has a thickness in the range of about, but not limited to, 6 to 9 inches. In one embodiment, the middle mattress 108 is made of a material, but not limited to, a foam, a gel-infused viscoelastic memory foam, and a polyurethane foam. The middle mattress 108 has a thickness in the range of about, but not limited to, 4 to 6 inches. In one embodiment, the top mattress 110 is made of a foam material, but not limited to, a gel memory foam. The top mattress 110 has a thickness in the range of about, but not limited to, 2 inches.

The mattresses (106, 108 and 110) are made from different materials and could be supplied in one of three different densities, i.e., soft, medium, or firm. The mattresses are supplied in 3 sections with each having a different task in providing the optimum comfort for the best sleep possible. The mattresses (106, 108 and 110) also is available in 4 sizes include twin, full, queen, and king.

Figure 3A:
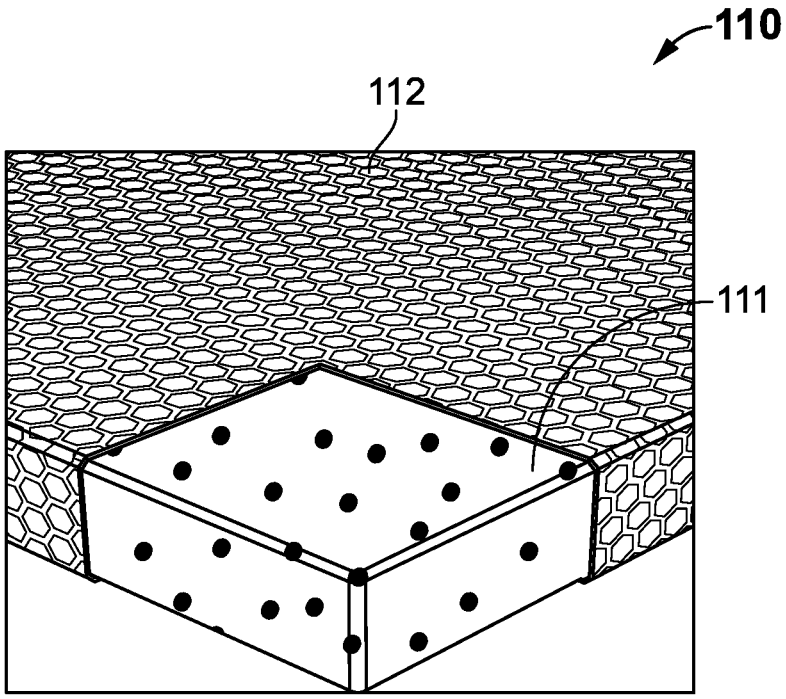
FIG. 3A shows a perspective view of a top mattress in an embodiment of the present invention.

Referring to FIG. 3A, the perspective view of a top mattress 110 is illustrated. In one embodiment, top mattress 110 comprises a gel memory foam 111 to provide comfort to the user 104 (shown in FIG. 1A). In one the top mattress 110 could be covered by, but not limited to, a cover 112 (shown in FIG. 3B). In one embodiment, the cover 112 (shown in FIG. 3B) is made of a material, but not limited to, a microfiber or microfibre.

Figure 3B:
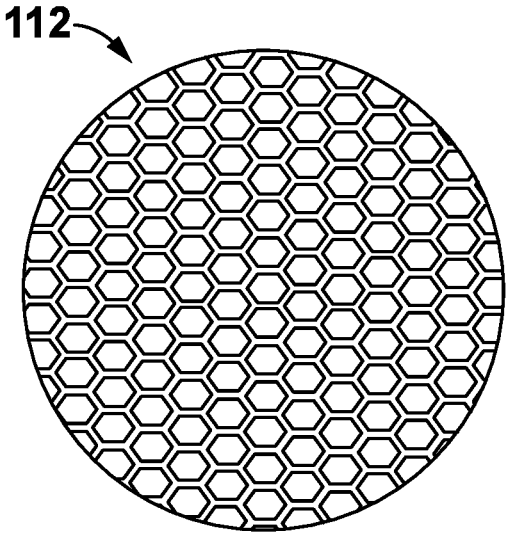
FIG. 3B shows an enlarged view of a cover for the mattresses in an embodiment of the present invention.

Referring to FIG. 3B, the enlarged view of a cover for the mattresses (106, 108 and 110) is illustrated. In one embodiment, the cover 112 is made of a material, but not limited to, a microfiber. In one embodiment, the cover 112 is 1800 thread count microfiber fabric. The microfiber is very comfortable and has a reasonably high coefficient of friction for fabric, which prevents slipping or sliding on the lower section during use. This movement is further reduced by reinforcing with, but not limited to, a hook and loop fabric and/or a rubberization. The material is cut to shape from bolts using computer controlled rolling cutters. The two halves are joined using a single stitch around the perimeter and then the cover 112 is turned inside out to develop a finished edge. In one embodiment, hook and loop fabrics are sewn to the mating locations of the mattresses (106, 108, and 110) and the durable plastic end zippers are sewn so each cover 112 which could be removed for washing. In one embodiment, the covers could be supplied in almost any vibrant color, pattern, or texture, so a distinctive fabric may be chosen to enhance the product recognition factor, which could dramatically improve the market adoption of the modular mattresses 100.

Figure 4:
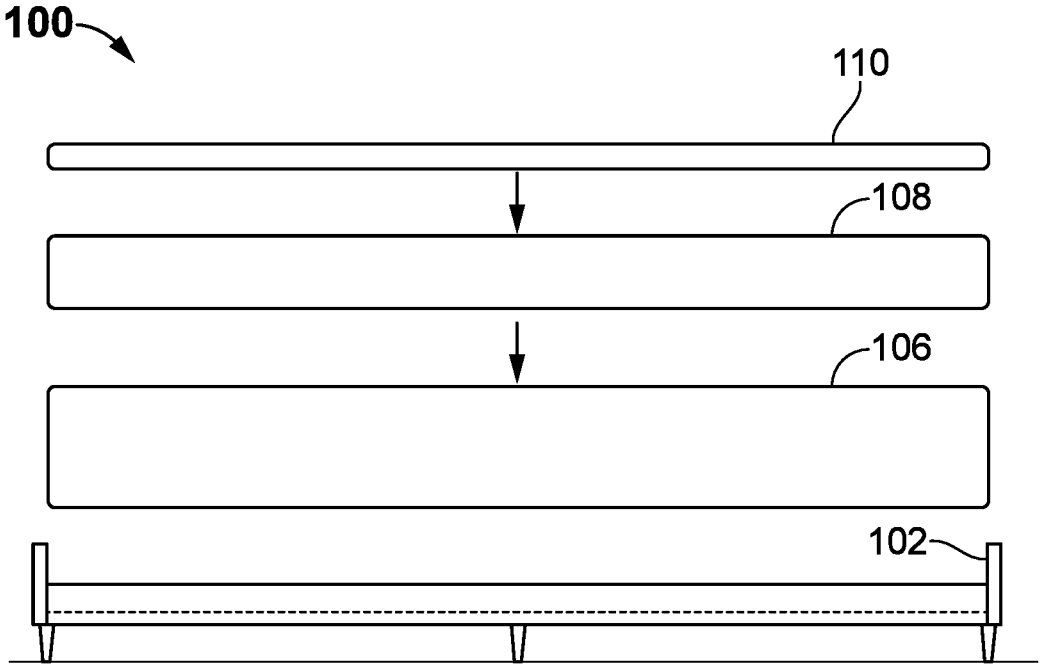
FIG. 4 shows a side view of the modular mattresses with a bed frame in an embodiment of the present invention.

Referring to FIG. 4, the side view of the modular mattresses 100 with a bed frame 102 is illustrated. In one embodiment, the bed frame 102 could be a high-quality finished hardwood bed frame. The bed frame 102 supports the mattress assembly up off the floor. In one embodiment, the lower mattress 106 could be fabricated using, but not limited to, a polyurethane foam. In one embodiment, the lower mattress 106 has a thickness in the range of about 9 inches. In one embodiment, the middle mattress 108 could be fabricated using, but not limited to, a polyurethane foam. This foam is supplied in one of 3 firmness levels to begin to create the optimum comfort required by the user 104 (shown in FIG. 1A). In one embodiment, the middle mattress 108 has a thickness in the range of about 6 inches.

In one embodiment, the top mattress 110 could be fabricated using, but not limited to, a gel-infused viscoelastic memory foam. In one embodiment, the top mattress 110 has a thickness in the range of about 2 inches. The 2" thickness provides the optimum in 'hug' without too much trampolining. The gel-infused viscoelastic memory foam evenly distributes weight and contours to the user's body curves, which provides relief for joints, back and neck during sleeping or resting. The gel-infused viscoelastic memory foam also provides optimum support to the lumbar and neck of the user 102 (shown in FIG. 1A). In one embodiment, the gel-infusion positioned at the top layer of the mattress 110 to maintains 69° F. at the point of body contact, which is the optimum in temperature for a good night's sleep.

In one embodiment, the top mattress 110 includes a cover 112 (shown in FIG. 3B). In one embodiment, a spun olefin fabric could be sewn on a top surface of the cover 112 (shown in FIG. 3B). The spun olefin fabric prevents liquid moisture from flowing into the top mattress 110 yet lets it breathe exceptionally well, expelling any water vapor. The cover 112 (shown in FIG. 3B) also conducts thermal energy well so the user's body temperature could be maintained. The top mattress 110 could be rotated 180° to reduce compression effects but it cannot be flipped as the gel is concentrated near the upper surface.

Figure 5:
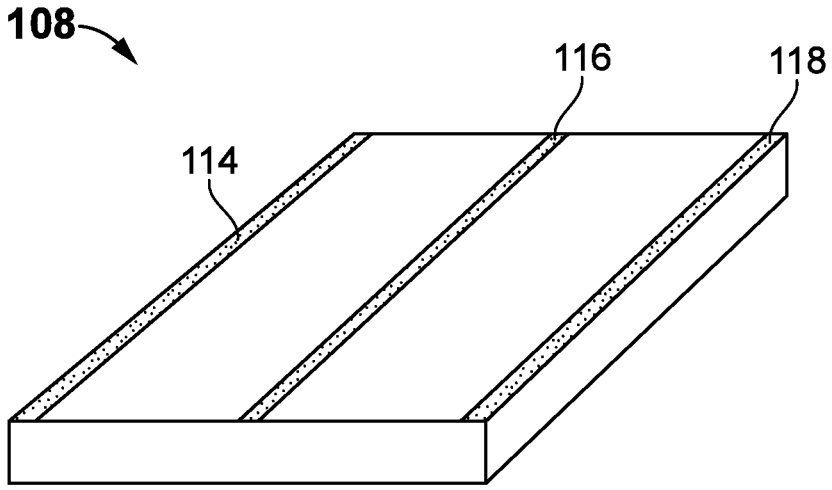
FIG. 5 shows a perspective view of the middle mattress in an embodiment of the present invention.

Referring to FIG. 5, the perspective view of the middle mattress 108 is illustrated. In one embodiment, the middle mattress 108 In one embodiment, an upper surface of the middle mattress 108 could be coated with, but not limited to, at least three 2" wide stripes of silicone rubber (114, 116 and 118), which prevents movement of the top mattress 110 during use. In one embodiment, the cover 112 (shown in FIG. 3B) of the middle mattress 108 could be a microfiber fabric. The microfiber fabric has a good friction coefficient so the mating microfiber cover 112 (shown in FIG. 3B) will not slip or slide during use, and the rubber strips (114, 116 and 118) plus the hook fabric reinforces the resistance to slip and slid on each other.

Figure 6:
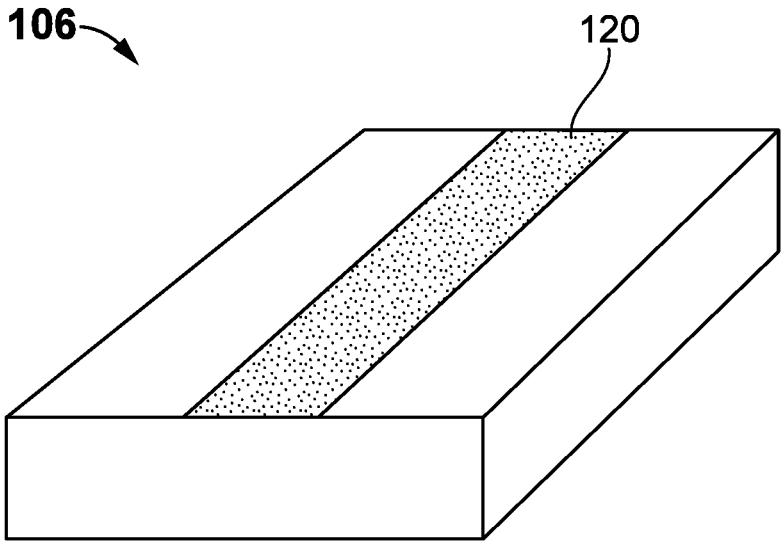
FIG. 6 shows a perspective view of the lower mattress in an embodiment of the present invention.

Referring to FIG. 6, the perspective view of the lower mattress 106 is illustrated.

In one embodiment, the lower mattress 106 is made of a foam, but not limited to, a polyurethane foam. This foam is supplied on one firmness to provide the most stable base possible for the mattress 106. The polyurethane foam of the lower mattress 106 has rounded edges. The foam block will support up to two 400-pound persons without any degradation. The foam is hypoallergenic and meets all national safety standards. In other embodiment, the modular base section could be augmented with a user assembled hardwood frame. This supports the base section using wooden slats on a 5-legged base with slightly raised sides. The legs allow the user 102 (shown in FIG. 1A) to clean under the edges and will support up to two 400-pound persons.

In one embodiment, the lower mattress 106 comprises a cover 112 (shown in FIG. 3B). The lower mattress 106 could be covered by the cover 112 (shown in FIG. 3B). In one embodiment, the cover 112 (shown in FIG. 3B) could be microfiber fabric. In one embodiment, the cover 112 (shown in FIG. 3B) comprises a fastener, but not limited to, a hook fabric at the middle section. The hook fabric of the cover 112 (shown in FIG. 3B) of the lower mattress 106 mates with a center section of loop fabric sewn into a lower surface of the middle mattress 108 to prevent movements during use. In one embodiment, the cover 112 (shown in FIG. 3B) could be provided with, but not limited to, durable plastic zippers. In one embodiment, an upper surface of the lower mattress 106 could be coated with, but not limited to, at least one 2" wide stripe of silicone rubber 120, which prevents movement of the middle mattress 108 during use.

Figure 7:
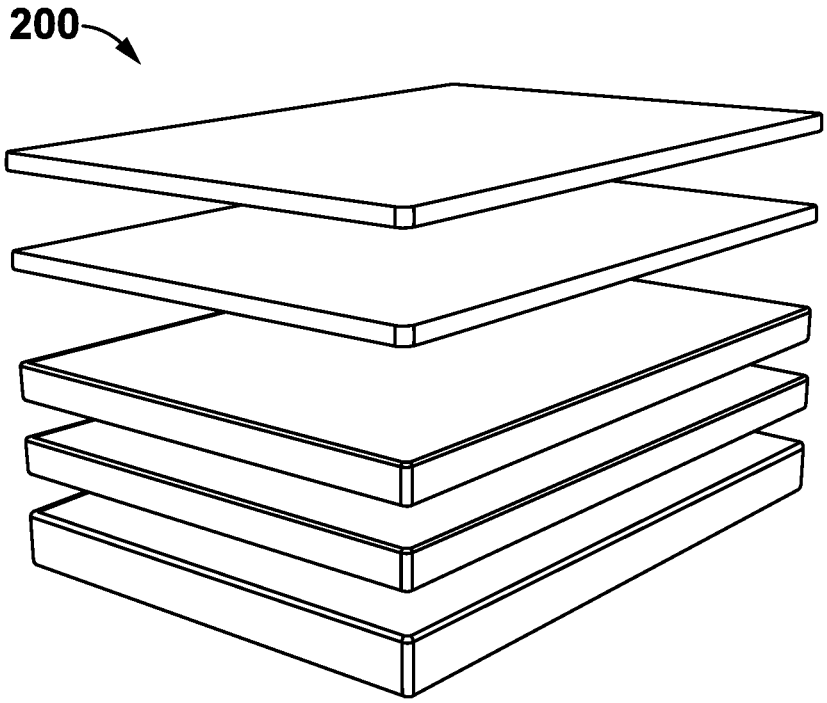
FIG. 7 shows a perspective view of the multiple mattresses in an embodiment of the present invention.

Referring to FIG. 7, the perspective view of the modular mattresses 200 is illustrated. In another embodiment, the modular mattresses 200 could be infinitely upgradeable with multiple mattresses that could be easily assembled and disassembled from the bed frame 102 (shown in FIG. 1A). The modular mattresses 200 could be replaced over time when worn allowing the user 104 (shown in FIG. 1A) to keep the sections that are still in good condition. The modular mattresses 200 could be adjusted according to a user's sleep patterns or sleep posture for providing optimum comfort. It could inexpensively be adjusted by purchasing a firmer or softer section to subtlety adjust the comfort of the mattress.

The advantages of the present invention include, the modular mattresses 100 could be designed to allow repeated assembly and disassembly and the upper, middle, and lower foam layers could be inexpensively replaced if they become too worn during use. The modular mattresses 100 are configured to provide comfort to any user, for example, side sleepers, stomach sleepers, and back sleepers while sleeping or resting. The top mattress 110 is sewn with a waterproof top cover 112 (shown in FIG. 3B) to prevent any moisture leakage into the memory foam. In one embodiment, the three covers are removable and then could be machine washed and line dried.

The modular mattresses 100 is designed to be aesthetic and effective in the application. The relative ease of manufacture and the moderately inexpensive components provide good marketability for the manufacturer. The user 104 (shown in FIG. 1A) benefits from improved comfort and the ability to inexpensively adjust the mattress as the user changes or it wears during use, which should provide considerable market interest in the product.

Preferred embodiments of this invention are described herein, including the best mode known to the inventors for carrying out the invention. It should be understood that the illustrated embodiments are exemplary only and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings in the foregoing descriptions. Although specific terms may be employed herein, they are used only in generic and descriptive sense and not for purposes of limitation. Accordingly, the present invention is not limited to the specific embodiments illustrated herein.

The present invention generally discloses mattresses. Further, the present invention discloses a modular mattress that allows for customization of the overall firmness, thickness, and breathability of the mattress along with providing an optimal comfort to users.

The invention claimed is:

1. A modular mattress comprising:

an upper mattress constructed with a foam material;

a middle mattress constructed with a foam material and positioned beneath the upper mattress, an upper surface of the middle mattress including a plurality of rubber strips that prevent the top mattress from shifting, and a lower mattress constructed with a foam material and positioned beneath the middle mattress, wherein each of the upper mattress, the middle mattress and the lower mattress are connected by a hook-and-loop fastener that prevents said upper mattress, said middle mattress and said lower mattress from shifting, and wherein the upper mattress, the middle mattress and the lower mattress each further include a top layer of a gel-infused viscoelastic memory gel memory foam positioned on an upper surface to enhance comfort for a person lying on said modular mattress.

2. The modular mattress according to claim 1 wherein an upper surface of the lower mattress includes a rubber strip that prevents said middle mattress from shifting.

3. The modular mattress according to claim 1 wherein each of the upper mattress, the middle mattress and the lower mattress includes a cover formed of a microfiber material.

4. The modular mattress according to claim 3 wherein the hook-and-loop fastener is arranged so the cover on the lower mattress includes a patch of hook-and-loop fastener for engaging a mating patch on the cover on the middle mattress, and the cover on the middle mattress includes a patch of hook-and-loop fastener for engaging a mating patch of hook-and-loop fastener on the cover on the upper mattress.

5. The modular mattress according to claim 3 wherein the cover is removable.

6. The modular mattress according to claim 1 wherein each of the upper mattress, the middle mattress and the lower mattress have different thicknesses.

7. The modular mattress according to claim 1 wherein the upper mattress has a thickness of less than 2 inches.

8. The modular mattress as in claim 1 wherein the lower mattress has a thickness between 6 inches and 9 inches.

9. The modular mattress according to claim 1 wherein the middle mattress has a thickness between 4 to 6 inches.

* * * * *